United States Patent [19]

Lempke et al.

[11] 4,141,647

[45] Feb. 27, 1979

[54] METHOD AND APPARATUS OF APERTURE FLOODING

[75] Inventors: George D. Lempke, Chicopee; Nils L. Hakanson, West Springfield, both of Mass.

[73] Assignee: A.B. Dick/Scott, South Hadley, Mass.

[21] Appl. No.: 802,827

[22] Filed: Jun. 2, 1977

[51] Int. Cl.[2] ..... G03D 13/00; G03D 3/08

[52] U.S. Cl. ..... 355/10

[58] Field of Search ..... 355/10, 7; 118/DIG. 23

[56] References Cited

U.S. PATENT DOCUMENTS 3,936,854 2/1976 Smith ..... 355/10 X

*Primary Examiner*—R. N. Envall, Jr.

*Attorney, Agent, or Firm*—Peter S. Lucyshyn

[57] ABSTRACT

A record processor employing a novel developing system, toner module and method in which a quantity of toner fluid is held adjacent to an electrostatic latent image on a film, in a substantially quiescent state, for a sufficiently long period to insure migration and adherence of toner particles to the image, is disclosed, wherein a set small quantity of fluid is drawn into a development chamber formed adjacent to the film which chamber is sized and shaped so as to facilitate the fluid reaching a relatively quiescent state quickly and which fluid is held in the chamber by a natural meniscus dam at a sharp edge formed across the flow path of the toner.

15 Claims, 4 Drawing Figures

METHOD AND APPARATUS OF APERTURE FLOODING

FIELD OF THE INVENTION

This invention relates to a record processor and especially with a novel developing apparatus and process for electrophotographic film such as may carry a latent electrostatic image.

BACKGROUND OF THE INVENTION

The use of electrophotographic techniques on microfiche-like film has resulted in a record processor apparatus which is versatile and extremely useful for the micro-recording and storing of information. One such apparatus is the commercially available System 200 record processor manufactured and distributed by A. B. Dick/Scott of South Hadley, Mass.

This system is generally described in U.S. Pat. Nos. 3,972,610; 3,916,828; and 3,927,639. Other such systems are described in U.S. Pat. Nos. 3,683,852 and 3,936,854.

In this type of apparatus, a film having a small latent electrostatic image, usually greatly reduced in size, is developed by exposing, for a short period, only the area having the image to a toner-bearing liquid, sometimes referred to as a monobath. This liquid toner usually comprises a suspension of very fine electroscopic particles colloidally suspended in a liquid carrier. Although a succession of liquids could be used, for convenience most, if not all, commercial applications employ a single liquid and the present invention will be described in this environment.

In most prior art systems, the liquid toner is usually caused to flow across the film area to be developed for a period and the area exposed thereafter to air or vacuum to aid in drying the liquid.

Although the prior art methods and apparatus for applying the toner have proven, over all, to produce acceptable results, certain problems have been found to exist. On occasional copies, there were found to be swirls or streaks and lack of definition in the developed image.

SUMMARY OF THE INVENTION

The present inventors have discovered that a major cause of this problem lies in the turbulence of toner flowing over the film and in the occasional presence of unwanted toner particles in the form of streaks and swirls in the image areas of the fiche due to evaporation rather than rapid evacuation of the toner. Although others have suggested the need for limiting turbulence during the flow of the toner, and have suggested a long period of stopped flow in a large chamber, the present invention provides means for substantially eliminating the turbulence during the development process while still carrying it out in a rapid manner. In accordance with the present invention the volume of the development chamber and the charge of toner is kept to a minimum for rapid evacuation of the toner, and the toner flow to the chamber is stopped for a short development period in which the toner reaches a relatively quiescent state.

The use of a small volume charge of toner, which is kept in a single mass adjacent to the image aids in removing all of the toner.

The exposure of the latent image to a relatively quiescent liquid toner for a period allows for toner particles to be attracted to and to adhere to the latent electrostatic image, to produce a better quality image.

The present inventors have discovered that by limiting the quantity of toner used in each developing cycle, to a small volume adjacent to the film, better results are produced with a lower rate of occurrence of the aforementioned problems. To this end one feature of the invention is to provide means for releasably damming the toner flow path just below the film area.

One feature of the present invention includes means for defining a meniscus in the flow path of the toner such that a meniscus dam is formed across the flow path to stop flow from the chamber. After a short substantially quiescent period during which particles of toner material migrate to and adhere to the electrostatically charged portions of the film area, the pressure across the dam is increased causing it to break and the liquid is emptied from the chamber in a body.

Another feature of the present invention contemplates the use of the energy of a relative pressure differential in a closed volume from another part of the toner system (e.g., a patrial vacuum in a sealed toner module) to move toner into the module. This provides for a damping or expcnentially decreasing force on the supplied toner as the displace toner itself changes the relative pressure (e.g., by partially filling the evacuated module).

The invention, together with the advantages thereof, may best be understood by reference to the following description taken in connection with the accompanying drawings, in the several figures of which like reference numerals identify like elements.

DETAILED DESCRIPTION OF THE FIGURES

Figure 1:
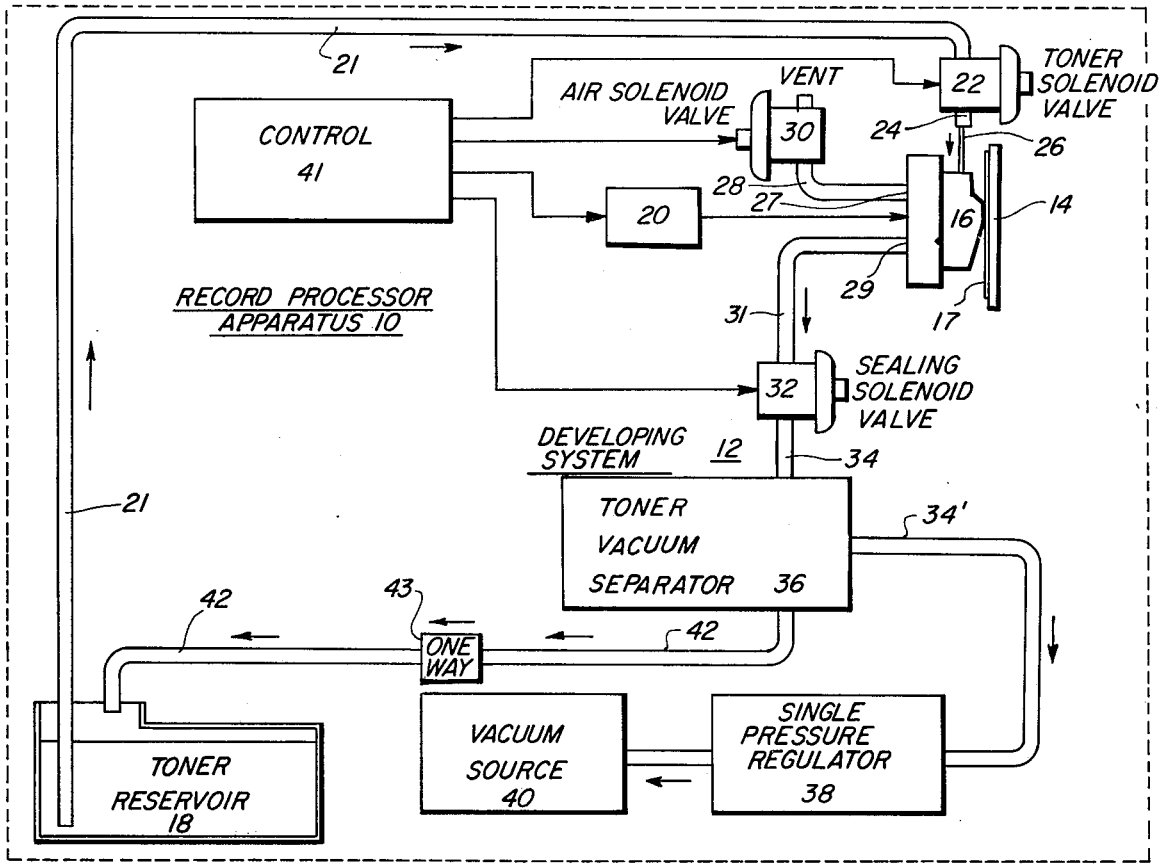
FIG. 1 is a diagrammatic view of a record processor apparatus constructed in accordance with the present invention, which view shows, in particular, the developing system of the apparatus.

Referring to FIG. 1, there is depicted a record processor apparatus constructed in accordance with the present invention and generally designated by the number 10. The processor 10 may be of the same construction as shown in the aforementioned U.S. Pat. No. 3,972,610, except for the development system, generally designated 12, which will be hereafter described in more detail. For brevity other portions of the apparatus 10 that are described in that printed patent will not be repeated here.

The apparatus 10 includes means 14 for supporting a film such as the film card 17, and for moving and indexing the film relative to a carriage which includes a novel toner module 16.

Means 20, such as a solenoid operated piston, are provided for moving the toner module 16 and the film 17 together in a sealing relationship to enclose a small portion thereof and to apply toner thereto in a novel process.

The construction of the toner module 16, which will shortly be explained in more detail, includes a toner input 26, an air input 27, and an outlet 29. The system 12, besides the toner module 16, includes a toner source, the reservoir 18, in which liquid toner is held. The liquid toner may be of any suitable type well known in this art, but preferably consists of black colored electroscopic particles such as carbon particles, colloidally suspended in a liquid vehicle. The reservoir 18 has an outlet line 21 which leads to a toner solenoid valve 22. The valve 22 serves to open or close communication between the line 21 and a toner feed line 24 which in turn communicates with an input tube 26 which feeds toner into the module 16.

As in the case of the system described in the aforementioned U.S. Pat. No. 3,927,639, no pump from the reservoir 18 to the inlet 26 is required as the system uses relative air pressure to remove toner from the reservoir and to fill the line 21.

The air inlet 27 of the toner module is connected via a line 28 to an air solenoid valve which serves to selectively communicate or not communicate the line 28 and air inlet 27 to the ambient atmosphere.

The toner module is connected through a line 31 to a sealing solenoid valve 32. The valve was not present in prior systems and serves the function of selectively communicating or not communicating the outlet 29 to a low pressure or partial vacuum source 40 via a line 34, a toner vacuum separator 36, line 34' and a pressure regulator 38. The regulator 38 is in this system a single high vacuum regulator and, unlike the system of the above cited U.S. Pat. Nos. 3,972,610; 3,916,828; and 3,927,639, only a single vacuum pressure need be used in the system 12.

The toner vacuum separator 36 may function in the conventional way to separate the toner from the vacuum line 34—34' and includes a toner outlet for allowing the recovered toner to gravity flow back to the reservoir 18 via a line 42. Suitable conventional means 43 such as a one way valve, or solenoid valve which is open during periods when a vacuum does not exist in the separator 36, serve to prevent any back flow from the reservoir 18 via line 42.

Suitable control means 41 for operating the means 20 and the valves 22, 30 and 32 is provided, for controling their operation in accordance with the operation to be described below. The construction of suitable controls, for achieving a desired sequence of operation, is well known and may take the form of electronic logic and timers or a cam sequence such as is described in the aforementioned U.S. Pat. No. 3,936,854. As the construction of such a control 41 is well within the skill of this art, for brevity, it will not be detailed here, except to set out its operation.

However, the operation of the system 12 and the method of applying the toner will be better understood after the construction of the module 16 is appreciated and, therefore, this will now be taken up.

Figure 2:
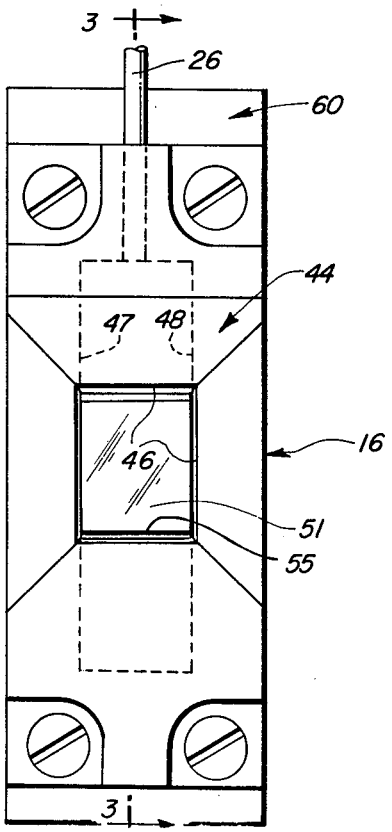
FIG. 2 is a front elevational view of a part, the toner module, of the apparatus of FIG. 1.

Referring to FIG. 2, the module 16 includes a front section 44 which defines a rectangular opening or aperture 46, which defines the area upon the film 17 which is to be developed. For example this area may be 0.185 square inches for 98 frames and 0.289 square inches for 60 frames per fiche but will vary for other formats. The interior of the front section 44 has a pair of spaced apart vertical walls, 47, 48 between which, as is better seen in FIG. 3, an insert 49 is received, in a close fit.

Figure 3:
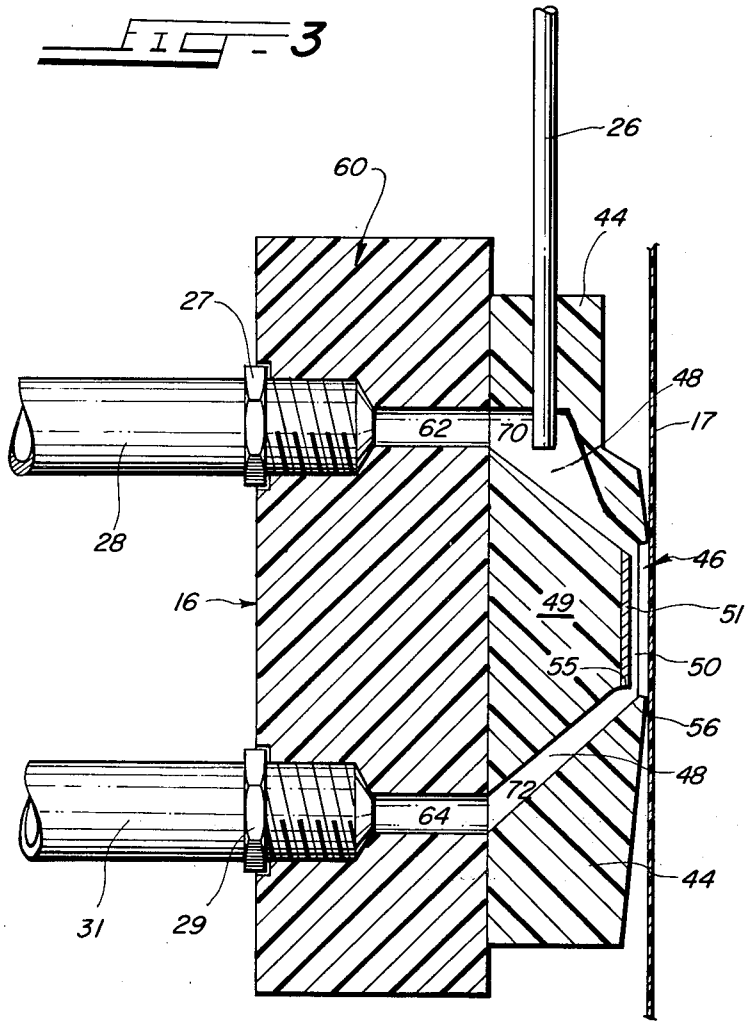
FIG. 3 is a sectional elevational view of the module of FIG. 2 as seen from the line 3—3 in FIG. 2.

The rectangular opening 46 lies in a plane and the adjacent surfaces of the front section 44 are included away from that plane so that the edge 48 of the opening 46 meets and presses against and into the film 17 to form a seal thereagainst, as is shown in FIG. 3.

The insert 49 includes an electrically conductive front plate or electrode 51, which is positioned parallel to but spaced from the opening 46 by a small distance. The plate 51 is connected to a source of electric potential by means, not shown, as is conventional for this type of processor. The plate 51, the interior walls of opening 46, and the film define a chamber 50 which is, in accordance with a feature of the present invention, low in volume for rapid evacuation of toner. Flooding of the aperture can be accomplished with a space between the film and electrode of from 0.020–0.060 inches, but for proper evacuation of the toner and drying of the film this spacing could be 0.031 inches for the 98 and 0.041 inches for the 60 frame format.

The toner outlet 26 is preferably constructed and positioned close enough to the upper surface of insert 49 so as to cause a toner charge to flow in a body down that surface without excessive splashing, and down the front surface of plate 51, in response to the charging process which will be explained below. The tube 26 may be made so as to be, initially, vertically adjustable so an optimum position can be found by experiment.

The module 16 also includes a back section 60 in the air inlet 27 for the line 28 and the outlet 29 to which the line 31 is attached. From the round openings of inlet 27 and outlet 29 the back section 60 defines rectangular, in cross-section, passages 62 and 64. As can be seen in FIG. 3 the insert 49 is shaped in relation to the interior of the front section 44 so as to form passages 70, 72 with tapering top and bottom walls from rectangular passageway 62 and 64 toward the chamber 50. The internal jointing lines between the sections 44 and 60 and the insert 49 and the plate 51 are preferably made smooth so as to provide no spaces for toner droplets to cling and to reduce turbulence in toner flow.

Figure 4:
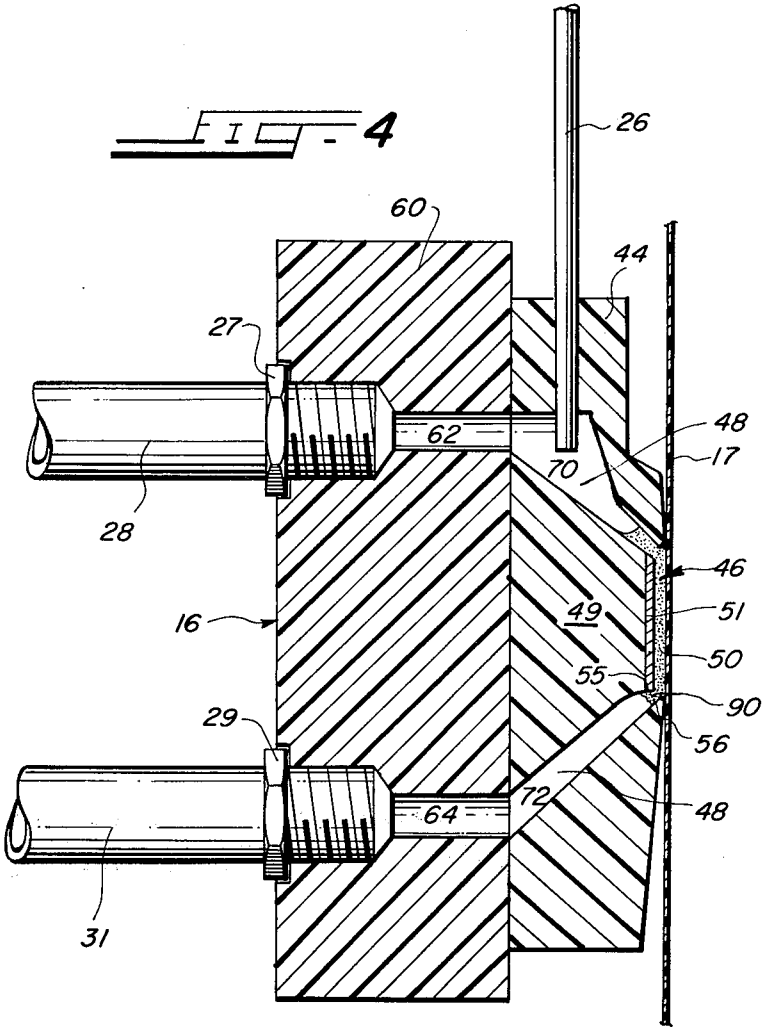
FIG. 4 is a sectional elevational view of the module similar to that of FIG. 3, illustrating a charge of toner held in the toner module by a meniscus dam.

Also, the bottom of the plate 51 at the downstream side of toner flow past the opening 46 is provided with an edge 55 which projects into the passageway and is positioned, in accordance with a feature of the present invention, close enough to the bottom interior wall (at 56) of the front section 44 so as to provide a means for releasably damming the toner and for allowing the toner to form a meniscus dam 90 at this point, as shown in FIG. 4.

Operation

Having described the structure of the module 16 and of the system 12, we now turn to the operation of the system and the process by which development of an image occurs in accordance with the present invention.

It should be understood that at the start of each cycle the line 21 (FIG. 1) is already filled with liquid toner. On set up of the processor 10 this is accomplished most easily by cycling the system 12 until a vacuum has drawn the fluid from reservoir 18 to solenoid valve 22.

At the beginning of a developing process cycle, the control means 41 causes the means 20 to bring the toner module 16 into sealing contact with the film 17 about the area to be developed. The solenoid valves 22, 30 and 32 are in their closed state at this point in time and the interior of the module 16 and the system of interconnected passageways and chambers between these valves is thus closed off and sealed from the outside atmosphere and other parts of the processor 10.

Next, the control 41 opens the sealing solenoid valve 32 for a short period of time, producing a partial vacuum in the closed passageway system. The valve 32 is then closed.

After this, the toner solenoid valve 22 is opened for a short period of time, allowing a small charge of toner to be drawn into the passageway system because of the partial vacuum therein. The toner flows from valve 22 through line 24, tube 26 and into the chamber 50 to the gap between edge 55 and the surface 56 (FIG. 4). Due to the sharp edge at 55, a meniscus is formed and because of the small gap, this meniscus bridges across the opening to surface 56, to form a meniscus dam 90, which prevents toner from flowing past the gap. The flow of the toner is disrupted and there is a build up which fills the chamber 50 flooding the portion of the film 17 enclosed by rectangular opening 46. The toner needs to be held there for a short period of time to interrupt the flow of the toner, during which time period the toner may reach a somewhat quiescent state. Also, during that period of time the toner particles migrate and adhere to the latent image on the film. The small charge of toner is believed to act like a coherent mass, which is contemplated to aid in the full evacuation of toner after the development process is completed.

The vacuum system of drawing liquid toner results in the toner being moved initially under a limited force but as the small toner charge begins to enter the sealed chamber system it decreases the partial vacuum and exponentially decreases the force. This smooth exponential damping of the toner flow is thought to aid in the control of toner movement so as to enhance image development.

The toner valve 22 is turned off after sufficient toner has flowed into the chamber 50 to rise to a point above the opening 46 as shown in FIG. 4.

During this period, as is conventional, the plate 51 serves as an electrode in the manner described in the aforementioned U.S. Pat. No. 3,972,610.

After the stop flow period the control 41 opens the air valve 30 and after a slight delay the sealing valve 32 to communicate ambient air pressure via line 28 to inlet 27 and partial vacuum pressure via line 31 to outlet 29. The result is in an air pressure differential across the toner charge in the chamber 50. This breaks the meniscus dam, and the charge of toner is carried along through the passageway 72 and out the outlet 29 and lines 31 and 34 to the separator 36. The valves 30 and 32 are left open to provide a partial vacuum and air flow through the toner cell which dries the toner left on the film 17.

After a period of time, the control 41 causes the means 20 to move the film 17 and module apart with the solenoid 32 still open to communicate vacuum to the opening 46. This allows air to flow inward between the film and the edge of the opening 46 and serves to remove any liquid toner still left at these areas.

Next, the sealing valve 32 and air valve 30 are closed and the system 12 is ready to begin another cycle.

The record processing apparatus 10 may now fix the developed image in the film in the manner described in the aforementioned patents.

A prototype of the above described invention was constructed and it functioned in accordance with the above method to develop good quality images on film. In this prototype acceptable results were obtained with a 0.12 seconds pulse time and a 0.9 seconds toner flow time. The pulse time is the length of time valve 32 is open to create the partial vacuum in the module and the toner flow time is the length of time valve 22 is open causing the toner to flow into the module. The air valve 30 is opened simultaneously with the closing of the toner valve 22. The valve 32 is thereafter opened after 0.28 to 0.38 seconds (for the smaller and larger film sized models, respectively).

It should be noted that the meniscus dam allows the bottom of chamber 50 to be defined at the bottom of the opening 46 and thus requires less toner. The small volume of the chamber itself uses less toner, but more importantly, requires less time to fill and to stop flow of the toner. The narrow gap between the electrode plate 51 and film 17 also aids in evacuating the toner.

The use of the pressure differential of a small closed volume such as is defined by the module 16 and the lines 24, 26, 28 and 31 provides for a declining force for moving the toner charge into the module as the incoming toner partially fills the vacuum therein and reduces the relative pressure between the closed chamber and the toner source. This causes the toner charge to progressively enter the chamber with less and less kinetic energy, and allows the toner flow to be stopped rapidly, (even permitting it to reach a relatively quiescent state).

These features of the invention, result in an improvement in the developed image over similar systems such as that described in the above A. B. Dick/Scott patents with less incidence of gross errors such as streaks or swirls, and yet allows for fast cycling of the development process.

It should now be appreciated that a new and unobvious record processor, method of developing, process of changing toner and developing module structure have been described which have advantages over the prior art.

While one particular embodiment of the invention has been shown and described, it will be obvious to those skilled in the art that changes and modifications may be made without departing from the invention in its broader aspects and, therefore, the aim in the appended claims is to cover all such changes and modifications as fall within the true spirit and scope of the invention.

We claim:

1. In a record processor apparatus of the type that can develop a latent electrostatic image area on a film, using a liquid toner, the combination of:

means for holding the film;

a toner module, which defines a small volume chamber with an open side sized to the image area to be developed on the film;

means for moving the film holding means and the toner module together so that the module opening makes sealing contact about the image area on film held by the holding means to form a chamber; and means for allowing flow of a small charge of liquid toner to the chamber formed by said toner module and the film, such charge being of a volume such as is required to fill the chamber, means for stopping the flow of the toner and for holding the charge of toner adjacent to the film area for a short period of time sufficient to interrupt the flow of the particles of toner and permit them to migrate to and adhere to the latent image thereon, and means for then removing the liquid toner from the chamber and drying the toner adhering to the image.

2. The record processor apparatus as defined in claim 1 wherein said toner module includes an electrode plate which is generally parallel to the film contacting opening and sized to that opening and spaced therefrom by a relatively small distance to define the back of the chamber.

3. The record processor apparatus as defined in claim 2 wherein said film area to be developed is on the order of one tenth to three tenths square inches and the plate is spaced therefrom in use by a distance on the order of two to six hundredths of an inch.

4. The record processor apparatus of claim 3, wherein the film area to be developed is approximately 0.185 square inches and the plate is spaced therefrom approximately 0.031 inches.

5. The record processor apparatus of claim 3, wherein the film area to be developed is approximately 0.289 square inches and the plate is spaced therefrom approximately 0.041 inches.

6. The invention of claim 1 wherein the apparatus includes means for sealing the chamber and its inlets and outlets from the ambient atmosphere to form a closed system and wherein the toner is charged into the system by first producing a small relative pressure differential between the closed system and the toner source wherein the closed system is initially at a lower pressure, and by then opening a passageway to the toner source so that the flow of toner source into the system decreases the relative pressure difference.

7. The process of charging a quantity of liquid toner from a liquid toner source into a toner module, which has a toner input, a line connecting the input to the source and a toner valve operably associated with the toner source and line for selectively permitting or stopping flow through the line, which source and line are so connected as to provide little or no flow of toner when the toner valve is open absent a lower air pressure in the module than in the source comprising the steps of:

(a) providing, with the toner valve closed, a small differential pressure between the module and the source with the module at a lower pressure than the source, and (b) opening the toner valve, thereby causing toner to flow into the module and resulting in a decrease in the small fixed differential pressure as the toner flows.

8. The process of claim 7 wherein the small differential pressure is obtained by decreasing the pressure in a closed volume including the interior of the toner module.

9. In an electrostatic image developer apparatus of the type that uses a liquid toner which is moved through a flow path past an image developing area, improvement of means defined in the flow path of the liquid toner, at or below the downstream side of the image developing area, for developing a meniscus dam across the path, behind which the liquid toner may be dammed up to flood the image development area, and means for establishing, at different times, relative pressures in the flow path that allow the meniscus dam to form, the toner flow to stop and flood the developing area, and then for breaking the meniscus dam to cause the toner to drain away from the developing area.

10. The invention of claim 9 wherein the means for developing a meniscus dam is means defining a sharp edge projecting into and across the flow path.

11. The invention of claim 10, wherein the apparatus includes a toner module which has an opening sized and shaped to be brought into sealing contact with a small area of film on which the electrostatic latent image may be formed, and which includes an electrode plate positioned within the module a small distance from the opening and wherein said means for developing a meniscus dam includes the lower edge of said plate which projects outward just below the opening, into a flow path defined by the module.

12. The invention of claim 9 wherein the distance between the plate and film is on the order of 0.020 to 0.060 inches.

13. The method of developing an electrostatic image on a film using apparatus which includes means defining a chamber adjacent to the area to be developed and a sharp edge surface in the flow path from the chamber, comprising the successive steps of:

(a) flooding the chamber with toner at a rate and under pressure such that a meniscus dam may form across the sharp edge surface;

(b) stopping the flow to the chamber for a period such as to allow the toner dammed up in the chamber to reach a quiescent state and develop the film area; and (c) increasing the relative pressure across the dam so as to break the meniscus dam and to empty the chamber of toner.

14. In apparatus for developing an electrostatic latent image on an electrophotographic film of the type which comprises: a developing chamber forming a passageway through which electrostatically charged toner particles are conducted to contact the film, the chamber having an opening against which the film is placed to form a seal, inlet means for allowing toner particles and air to enter the chamber, and an outlet through which toner particles and air leave the chamber; supply means for providing toner particles to be passed through the chamber; toner flow control means, operably coupled to said supply means, for permitting a predetermined quantity of toner particles to flow through the developing chamber at predetermined times; air supply means operably coupled for supplying drying air to the inlet of the chamber; and vacuum means connected to the outlet of the chamber for drawing the toner particles and the air through the chamber, the vacuum means creating sub-atmospheric pressure within the chamber to prevent leakage of toner particles from the chamber around the film, the improvement comprising:

having said developing chamber be of a small volume, substantially sized to the film opening, and providing means for releasably damming the toner flow which means are provided at or near the outlet from the small volume chamber, whereby a small volume of toner may be dammed up in the chamber to flood it and be kept adjacent to the film area in a stopped flow state for a period sufficient to develop the image thereon and may thereafter be evacuated.

15. The improvement of claim 14 wherein:

said volume of said chamber is less than two hundredths of a cubic inch; and said means for releasably damming the toner includes means for forming a meniscus dam across the outlet of the chamber.

* * * * *

UNITED STATES PATENT AND TRADEMARK OFFICE

CERTIFICATE OF CORRECTION

PATENT NO. : 4,141,647

DATED : February 27, 1979

INVENTOR(S) : George D. Lempke et al.

It is certified that error appears in the above-identified patent and that said Letters Patent are hereby corrected as shown below:

Column 2, line 25, "displace" should read ---displaced---.

Column 3, line 67, "included" should read ---inclined---.

Column 6, line 32, "changing" should read ---charging---.

Signed and Sealed this

*Eighteenth* Day of *September 1979*

[SEAL]

*Attest:*

*Attesting Officer*

LUTRELLE F. PARKER

*Acting Commissioner of Patents and Trademarks*